United States Patent [19]

West et al.

[11] 4,105,272

[45] Aug. 8, 1978

[54] HIGH CURRENT GROUNDING ASSEMBLY HAVING RIGID INTERCONNECTING CONDUCTORS

[75] Inventors: Edward L. West; Melvin E. Clutter, both of Centralia, Mo.

[73] Assignee: A. B. Chance Company, Centralia, Mo.

[21] Appl. No.: 814,285

[22] Filed: Jul. 11, 1977

[51] Int. Cl.[2] ..... H01R 3/06

[52] U.S. Cl. ..... 339/14 L; 339/246; 339/264 L

[58] Field of Search ..... 339/14 R, 14 P, 14 L, 339/13, 22 B, 109, 110 R, 229, 239, 246, 249 A, 264 R, 266 R

[56] References Cited

U.S. PATENT DOCUMENTS

| | | | |
|---|---|---|---|
| 3,177,459 | 4/1965 | Toedtman | 339/246 X |
| 3,544,956 | 12/1970 | Bricker, Jr. | 339/264 L |

*Primary Examiner*—Roy Lake
*Assistant Examiner*—DeWalden W. Jones
*Attorney, Agent, or Firm*—Schmidt, Johnson, Hovey & Williams

[57] ABSTRACT

A high current grounding assembly especially adapted for electrically interconnecting and grounding substation phase buses conductors is provided which includes rigid metallic connector elements capable of handling extremely high fault current loads without violent whipping or other motions. The clamp and connector assembly, or one of the phase busses, is connected to ground in order to protect linemen or other workers in the vicinity of the assembly from the effects of fault or inductive currents. In preferred forms, novel conductor-gripping clamps and rigid tubular connector elements may be partially or completely preassembled and thereafter installed on phase busses. The clamps include a shiftable gripper for engaging a respective phase conductor, with a pair of transversely disposed clamp sections on the underside of the gripper for receiving and gripping the rigid connector elements; this construction presents the shortest possible current path through the clamps, which is important when very high fault currents or the like must be grounded.

7 Claims, 5 Drawing Figures

HIGH CURRENT GROUNDING ASSEMBLY HAVING RIGID INTERCONNECTING CONDUCTORS

This invention relates to an improved grounding assembly especially adapted for temporary grounding of substation phase busses or other equipment, as for example when a lineman must work in close proximity to such equipment. More particularly, it is concerned with a grounding assembly which includes rigid connective elements between respective phase conductors or the like. In addition, a novel clamp unit is provided which includes a shiftable gripper for engaging a phase bus or other conductor which has a pair of side-by-side, transversely disposed connector-receiving clamp sections on the face of the gripper remote from the phase conductor; in this manner the current path through the clamp assembly is minimized to further facilitate effective grounding.

It is common practice to ground unenergized phase busses or other conductors when linemen or others must work in the vicinity thereof. A number of grounding assemblies have been proposed in the past for use in this context, and the present invention is concerned with a novel grounding assembly useful for such grounding, especially in the case of relatively high capacity transmission and distribution systems.

It is therefore the most important object of the present invention to provide a grounding assembly for electrically connecting phase conductors or the like and grounding the same which includes rigid connective structure between the respective phase lines or conductors, in conjunction with novel clamping structure for the respective conductors.

Another aim of the invention is to provide a grounding assembly of the type described which includes at least one, and possibly a pair, of tubular metallic connector elements which are coupled between phase busses or conductors by means of clamping structure, along with means for grounding the electrically interconnected phase busses; this construction allows stepwise mounting of the components onto the busses or conductors, followed by final interconnection thereof, so that installation problems are minimized.

A still further object of the invention is to provide a novel electrical conductor clamp especially adapted for use in the grounding assembly hereof which includes a generally J-shaped body section along with a shiftable, cooperating gripper section for gripping a conductor; in addition, a pair of elongated, side-by-side clamps are provided on the face of the gripper section remote from the conductor, and are oriented generally transversely relative to the latter for allowing easy interconnection of rigid connector elements between the respective conductors.

Figure 1:
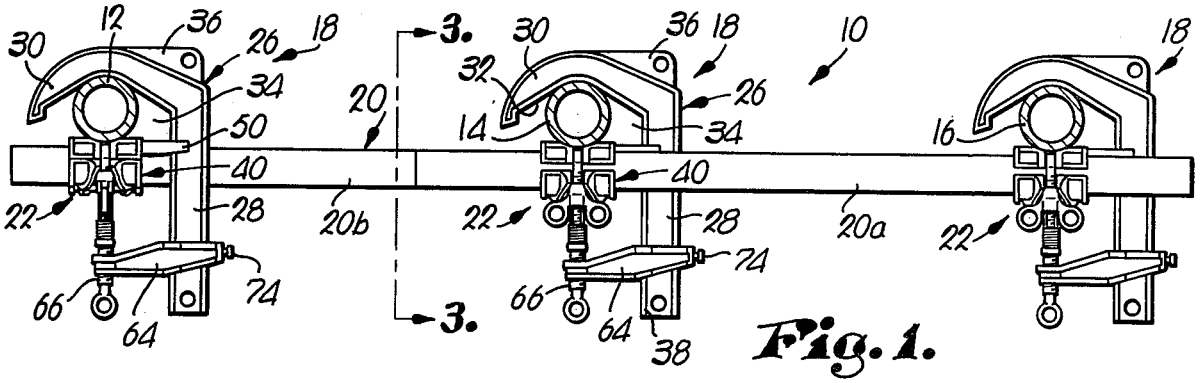
FIG. 1 is a side elevational view of the grounding assembly of the present invention mounted upon and electrically interconnecting three rigid substation phase busses.
Figure 2:
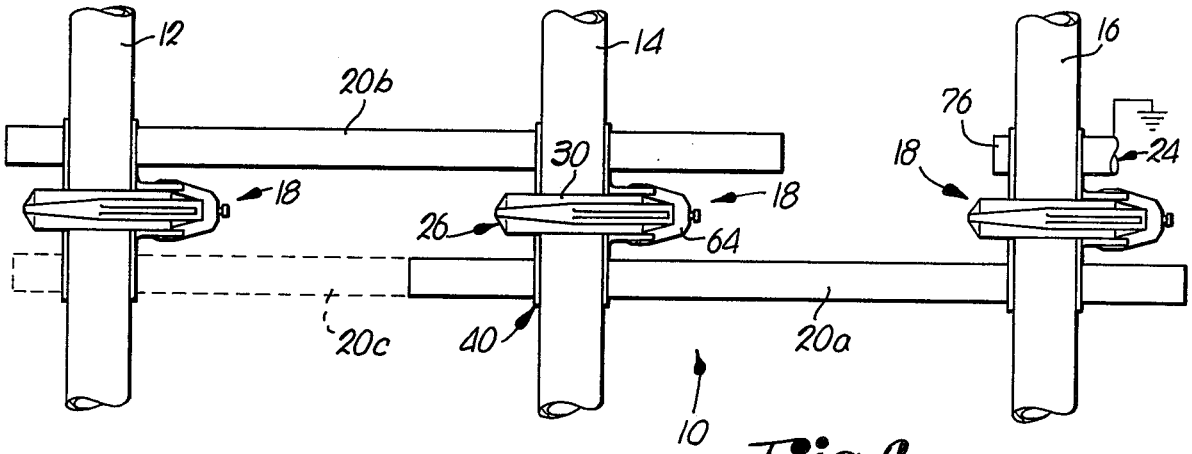
FIG. 2 is a fragmentary plan view of the installed assembly illustrated in FIG. 1, and further depicting separate embodiments of the invention in phantom.
Figure 3:
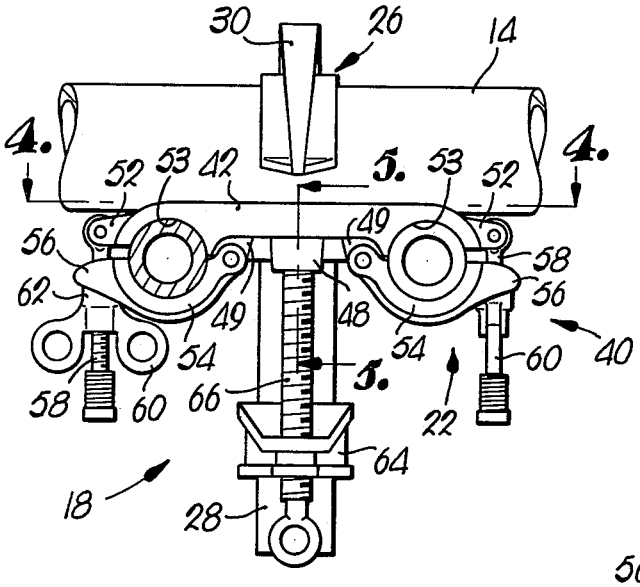
FIG. 3 is an enlarged sectional view taken along line 3—3 of FIG. 1 and further illustrating the construction of the preferred conductor clamp of the invention.

Turning now to the drawings, a grounding assembly 10 is illustrated in FIGS. 1 and 2. Assembly 10 serves to electrically interconnect and ground conventional phase busses 12, 14, and 16, of the type which would be located at a substation. The ensuing discussion will be primarily directed to use of the assembly hereof on phase busses and the like; it is to be understood, however, that the invention is not so limited and may be used on other types of conductors in a given system. The assembly 10 broadly includes three metallic, releasable, conductor-gripping clamps 18 mounted on each phase bus respectively, and structure including at least one elongated, rigid metallic connector element 20 serving to electrically interconnect the busses. In this regard, respective clamping means 22 forms a part of each overall clamp 18 for receiving and gripping the element 20. In addition, grounding means 24 is also provided for grounding the electrically interconnected phase busses.

Figure 4:
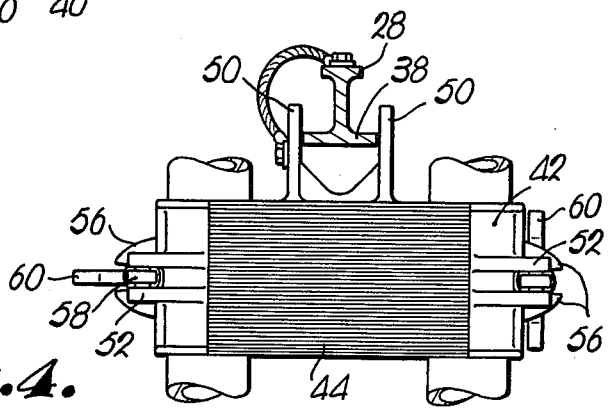
FIG. 4 is a sectional view taken along 4—4 of FIG. 3 which depicts the upper face of the clamp gripper.

In more detail, each clamp 18 includes an inverted, generally J-shaped body section 26 having an elongated portion 28 and an arcuate, conductor-engaging portion 30 having a lowermost bus-engaging surface 32 which in turn defines a downwardly opening, bus-receiving concavity 34. An upstanding, apertured eye section 36 is provided on arcuate section 30 for allowing placement of clamp 18 onto a bus through the use of conventional hot line tools such as a block and rope assembly and standard lifting equipment. As best seen in FIG. 4, elongated portion 28 of body 26 is somewhat I-shaped in cross section and includes a relatively wide, planar web 38.

Figure 5:
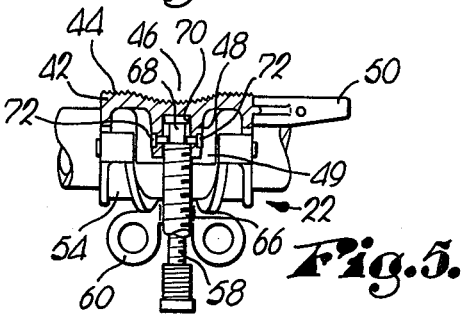
FIG. 5 is a vertical sectional view taken along line 5—5 of FIG. 3 which depicts additional constructional details of the shiftable gripper.

A gripper section 40 also forms a part of clamp 18 and is located in spaced, opposed relationship to surface 32 of arcuate portion 30. Gripper section 40 includes an elongated, uppermost, bus-engaging plate 42 which is oriented transversely with respect to body section 26 and along the length of the bus conductor received within the clamp 18. As best seen in FIGS. 4 and 5, the upper surface of plate 42 is longitudinally ribbed as at 44, and is configured to present a concavity 46 along the length thereof. Plate 42 also includes a depending annular boss 48, a pair of spaced, depending mounting blocks 49, and a pair of spaced, laterally extending guide elements 50. The latter are disposed on opposite sides of web 38 as best seen in FIG. 4, in order to slidably locate the gripper section 40 thereon.

Two opposed, oppositely and outwardly extending, spaced pairs of apertured tabs 52 are provided on the upper surface of plate 42 at the opposite ends thereof. Furthermore, the underside of plate 42 is configured to present a pair of elongated, side-by-side concavities 53. The longitudinal axes of the latter are at right angles relative to that of the ribs 44 and concavity 46, as will be readily apparent from the drawing. This concavity-defining structure forms a part of the clamp sections 22.

Each clamping means 22 further includes an arcuate lower jaw section 54 which is pivotally secured on opposite sides of the adjacent depending block 49 (see FIG. 5). The outermost end of each jaw 54 is in the form of a pair of spaced latch elements 56. A latching bolt 58 is pivotally mounted between each pair of tabs 52 and depends therefrom. A wing nut 60 is operatively mounted on each bolt 58 and includes a radially enlarged upper portion 62 which engages the undersides of latching ears 56. In the usual fashion, tightening of the wing nuts 60 causes the associated jaw sections 54 to close in relation to the proximal concavities 53 formed in the underside of plate 42. This in turn permits positioning of a rigid connector element 20 within the clamping means 22 so as to mechanically secure the same in place.

Selective shifting of gripper section 40 is accomplished through the use of a lower coupling member 64 and a depending bolt 66. Referring specifically to FIG. 5, it will be seen that the uppermost end of bolt 66 is provided with an axially aligned terminal projecting portion 68 of lesser radial dimension than the main body of the bolt, along with an uppermost, radially expanded collar 70. As shown, the upper end of bolt 66 and portion 68 are received within boss 48, and a pair of coupling rivets 72 are provided through the sidewall of boss 48 for capturing the same therein.

Coupling member 64 is shiftably mounted on elongated portion 28 of clamp body section 26, and is selectively secured in place by means of a set screw 74. The outermost end of member 64 is provided with a threaded bore for receiving bolt 66. In the usual fashion, bolt 66 can be rotated for alternately shifting gripper section 40 toward and away from arcuate portion 30.

In one assembly procedure, the components of assembly 10 are first interconnected. This involves placing a pair of separate, rigid metallic connector elements **20*a* and 20*b* within an appropriate clamping means 22 provided with the endmost clamps 18 of the assembly. These elements are advantageously made from aluminum or other suitable metallic material, and are in the form of rigid tubes. The associated wing nuts 60 are then tightened for clamping the elements 20*a* and 20*b* in place. The next step involves positioning the opposite ends of the elements 20*a* and 20*b* within the side-by-side clamping means 22 of the central clamp 18, whereupon the respective wing nuts 60 can be tightened in like manner. The assembly is then grounded and is ready for mounting on the spaced busses 12, 14 and 16. As seen in FIG. 2, a separate grounding conductor 76 can be placed in one of the unused clamps 22, or separate clamp and grounding structure can be mounted on one of the connector elements. Mounting of the assembly involves merely positioning the assembly such that the respective clamps 18 receive the individual busses in the manner best illustrated in FIG. 1, followed by tightening of the individual bolts 66 to cause the gripper elements 40** to move into gripping engagement with the associated busses.

In other embodiments, a single elongated connective element **20*c* can be provided (FIG. 2). Such an elongated element would be received by and connected to the appropriate clamping means 20 of all three of the clamps 18, as illustrated in phantom in FIG. 2**.

In other instances it may be advantageous to mount the respective clamps 18 individually onto the corresponding busses, followed by interconnection thereof. This stepwise procedure greatly facilitates mounting of the assembly on overhead conductors, for example.

Having thus described the invention, what is claimed as new and desired to be secured by Letters Patent is:

1. A grounding assembly for electrically connecting conductors and grounding the same, comprising:

a metallic, releasable, conductor-gripping clamp for each of said conductors;

means electrically interconnecting said clamps and thereby said conductors, including at least one elongated, rigid, metallic connector element, and means for mechanically securing and electrically connecting said element with said clamps; and means for grounding said electrically interconnected conductors.

2. The grounding assembly as set forth in claim 1 wherein a pair of separate, rigid, metallic, connector elements are employed for electrically interconnecting said clamps and conductors.

3. The grounding assembly as set forth in claim 1 wherein said connector element is of metallic tubular construction.

4. The grounding assembly as set forth in claim 1 wherein three of said conductors are provided which are generally parallel to each other, and said electrical interconnecting means comprises at least one, tubular, rigid connector element disposed transversely relative to said conductors, there being a conductor-gripping clamp on each conductor, said clamps also including structure interconnecting said connector element between said conductors.

5. The grounding assembly of claim 4 wherein each of said clamps comprises:

a generally J-shaped body section having an elongated body portion and an arcuate, conductor-engaging portion presenting a concavity for receiving a respective one of said phase conductors;

a gripper section in spaced, opposed relationship to the surface of said conductor-engaging portion defining said concavity, said gripper section including structure defining an elongated gripping area therein which extends transversely of the J-shaped section for engaging and gripping said respective phase conductor in cooperation with said concavity-defining surface, said gripper section further including means on the face thereof remote from said gripping area for defining a pair of elongated, side-by-side, conductor-gripping clamp sections which respectively extend transversely relative to said concavity, at least one of the clamp sections of each of said clamps receiving a rigid connector element; and means for operatively mounting said gripper section on said body portion, and for allowing selective shifting thereof toward and away from said arcuate portion, for releasable gripping of said respective phase conductor.

6. The grounding assembly of claim 5 wherein a pair of said connector elements are provided.

7. An electrical conductor clamp, comprising:

a generally J-shaped body section having an elongated body portion and an arcuate, conductor-engaging portion presenting a concavity for receiving a first conductor extending transversely of the J-shaped section;

a gripper section in spaced, opposed relationship to the surface of said conductor-engaging portion defining said concavity, said gripper section including structure defining an elongated gripping area therein which extends transversely of the J-shaped section for engaging and gripping said first conductor in cooperation with said first concavity-defining surface, said gripper section further including means on the face thereof remote from said gripping area for defining a pair of elongated, side-by-side, conductor-gripping clamp sections which respectively extend transversely relative to said concavity, said clamp sections each including structure for respectively receiving and gripping a second conductor extending transversely of said first conductor; and means for operatively mounting said gripper section on said body portion, and for allowing selective shifting thereof toward and away from said arcuate portion, for releasable gripping of said first conductor.

* * * * *